US010114336B2

(12) United States Patent
Shimizu et al.

(10) Patent No.: US 10,114,336 B2
(45) Date of Patent: Oct. 30, 2018

(54) CARTRIDGE MOUNTABLE TO IMAGE FORMING APPARATUS

(71) Applicant: CANON KABUSHIKI KAISHA, Tokyo (JP)

(72) Inventors: Hiroki Shimizu, Suntou-gun (JP); Osamu Anan, Susono (JP); Kazuki Matsumoto, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/481,359

(22) Filed: Apr. 6, 2017

(65) Prior Publication Data

US 2017/0293258 A1 Oct. 12, 2017

(30) Foreign Application Priority Data

Apr. 12, 2016 (JP) ..... 2016-079418

(51) Int. Cl.
*G03G 15/00* (2006.01)
*G03G 21/16* (2006.01)
*G03G 21/18* (2006.01)

(52) U.S. Cl.
CPC ..... *G03G 21/1842* (2013.01); *G03G 15/751* (2013.01); *G03G 21/1828* (2013.01); *G03G 2221/1609* (2013.01)

(58) Field of Classification Search
CPC ..... G03G 15/751; G03G 21/1671; G03G 21/1828; G03G 21/1832; G03G 21/1842; G03G 2221/1609
See application file for complete search history.

(56) References Cited

U.S. PATENT DOCUMENTS

2004/0190936 A1* 9/2004 Yoshiyuki ..... G03G 21/1832 399/114
2009/0297219 A1* 12/2009 Yoshino ..... G03G 21/1828 399/114
2010/0316420 A1* 12/2010 Mori ..... G03G 15/162 399/302
2015/0277256 A1* 10/2015 Sawamoto ..... C01G 49/0072 430/111.1

FOREIGN PATENT DOCUMENTS

| | | | |
|---|---|---|---|
| JP | 08-248842 | A | 9/1996 |
| JP | 2580387 | B2 | 2/1997 |
| JP | 2000-029368 | A | 1/2000 |
| JP | 2001-215846 | A | 8/2001 |
| JP | 3330463 | B2 | 9/2002 |
| JP | 2008-176157 | A | 7/2008 |
| JP | 2009-236995 | A | 10/2009 |

* cited by examiner

*Primary Examiner* — Sophia S Chen
(74) *Attorney, Agent, or Firm* — Canon U.S.A., Inc. IP Division

(57) ABSTRACT

A drum cartridge attachable to and detachable from a main body of an image forming apparatus includes a cleaning frame, a photosensitive drum rotatably supported by the cleaning frame, and an opening provided in the cleaning frame and configured to expose the photosensitive drum. In a factory default state of the drum cartridge, handling caution information is printed in at least part of a region of a surface of the photosensitive drum, the region being exposed from the opening.

14 Claims, 8 Drawing Sheets

CARTRIDGE MOUNTABLE TO IMAGE FORMING APPARATUS

BACKGROUND OF THE INVENTION

Field of the Invention

The present disclosure relates to a cartridge mountable to a main body of an image forming apparatus, such as a copier, a printer, or a facsimile machine.

Description of the Related Art

Image forming apparatuses that form an image on a recording material using an electrophotographic image forming method (electrophotographic process) are known. Examples of the image forming apparatuses include copiers and printers, such as laser beam printers and light-emitting diode (LED) printers. The examples also include facsimile machines, word processors, and multifunction peripherals (multifunction printers) combining these functions.

In an image forming apparatus using an electrophotographic image forming method, an electrophotographic photosensitive member (hereinafter simply referred to as "photosensitive member") serving as an image bearing member is uniformly charged. Then, the charged photosensitive member is selectively exposed to light to form an electrostatic latent image on the photosensitive member. Next, a developer (toner) is supplied onto the electrostatic latent image on the photosensitive member to visualize it into a toner image. Then, the toner image formed on the photosensitive member is transferred onto a recording material, such as a recording sheet or plastic sheet. By applying heat and pressure to the toner image on the recording material, the toner image is thermally fused and fixed on the recording material.

An image forming apparatus, such as that described above, generally requires maintenance of various image formation processing units. To facilitate the maintenance of the various image formation processing units, a process cartridge is adopted, which is formed by combining a photosensitive member, a charging unit, a developing unit, and a cleaning unit into a frame. The process cartridge is detachably mounted to the main body of the image forming apparatus. With this process cartridge technique, an image forming apparatus with excellent usability can be provided.

In the process cartridge described above, a cleaning frame supports a photosensitive drum, a charging roller for charging the surface of the photosensitive drum, and a cleaning member that scrapes off developer remaining on the surface of the photosensitive drum. The photosensitive drum is rotatably supported by a bearing member on the cleaning frame.

In the process cartridge described above, the surface of the photosensitive drum is partly exposed from an opening in the frame. As a result, the user may touch the surface of the photosensitive drum. If the user touches the surface of the photosensitive drum, the resulting adhesion of finger oil or the like to the surface of the photosensitive drum may affect image quality.

To prevent the user from touching the surface of the photosensitive drum, the surface of the photosensitive drum may be covered with a drum cover. The drum cover has the function of protecting the surface of the photosensitive drum from light, dust, and user's touch. To further reduce the risk of the user accidentally touching the surface of the photosensitive drum, Japanese Patent Laid-Open No. 2000-029368 discloses a technique in which a message warning the user not to touch the surface of a photosensitive drum is printed on a flexible sheet member jutting from one edge of an opening in a frame.

Japanese Patent Laid-Open No. 08-248842 and No. 2008-176157 disclose techniques in which the life of an image bearing member, the lives of components of an image forming unit, and apparatus information including various lives, operating conditions, and environments of an image forming apparatus, are displayed as a toner image on the image bearing member by an image forming device. However, the techniques disclosed in Japanese Patent Laid-Open No. 08-248842 and No. 2008-176157 are not designed to prevent the user from touching the surface of a photosensitive drum.

The process cartridge may be mounted to the main body of the image forming apparatus after removal of the drum cover covering the surface of the photosensitive drum. When the process cartridge is mounted on the main body of the image forming apparatus, the surface of the photosensitive drum is partly exposed from the opening in the frame. Therefore, after removal of the drum cover, the user may touch the surface of the photosensitive drum before the process cartridge is inserted into the main body of the image forming apparatus.

With a recent increase in the life of process cartridges, a technique has been proposed in which a drum cartridge including a photosensitive drum and a developing cartridge including a developing device are configured as separate components. The drum cartridge and the developing cartridge can thus be replaced separately. This configuration increases the surface area of the photosensitive drum exposed from the opening in the frame. Accordingly, it is required to provide a configuration that prevents the user from touching the surface of the photosensitive drum.

SUMMARY OF THE INVENTION

The present disclosure has been made to solve the problems described above. The present disclosure provides a cartridge that can prevent the user from touching an image bearing member.

Specifically, the present disclosure provides a cartridge that is mountable to a main body of an image forming apparatus and includes a frame, an image bearing member rotatably supported by the frame, and an opening provided in the frame and configured to expose the image bearing member. In a factory default state of the cartridge, handling caution information is printed in at least part of a region of a surface of the image bearing member, the region being exposed from the opening.

Further aspects of the present disclosure will become apparent from the following description of exemplary embodiments with reference to the attached drawings.

DESCRIPTION OF THE EMBODIMENTS

A process cartridge and an image forming apparatus including the process cartridge according to an embodiment of the present disclosure will now be described with reference to the drawings.

(Image Forming Apparatus)

Figure 1:
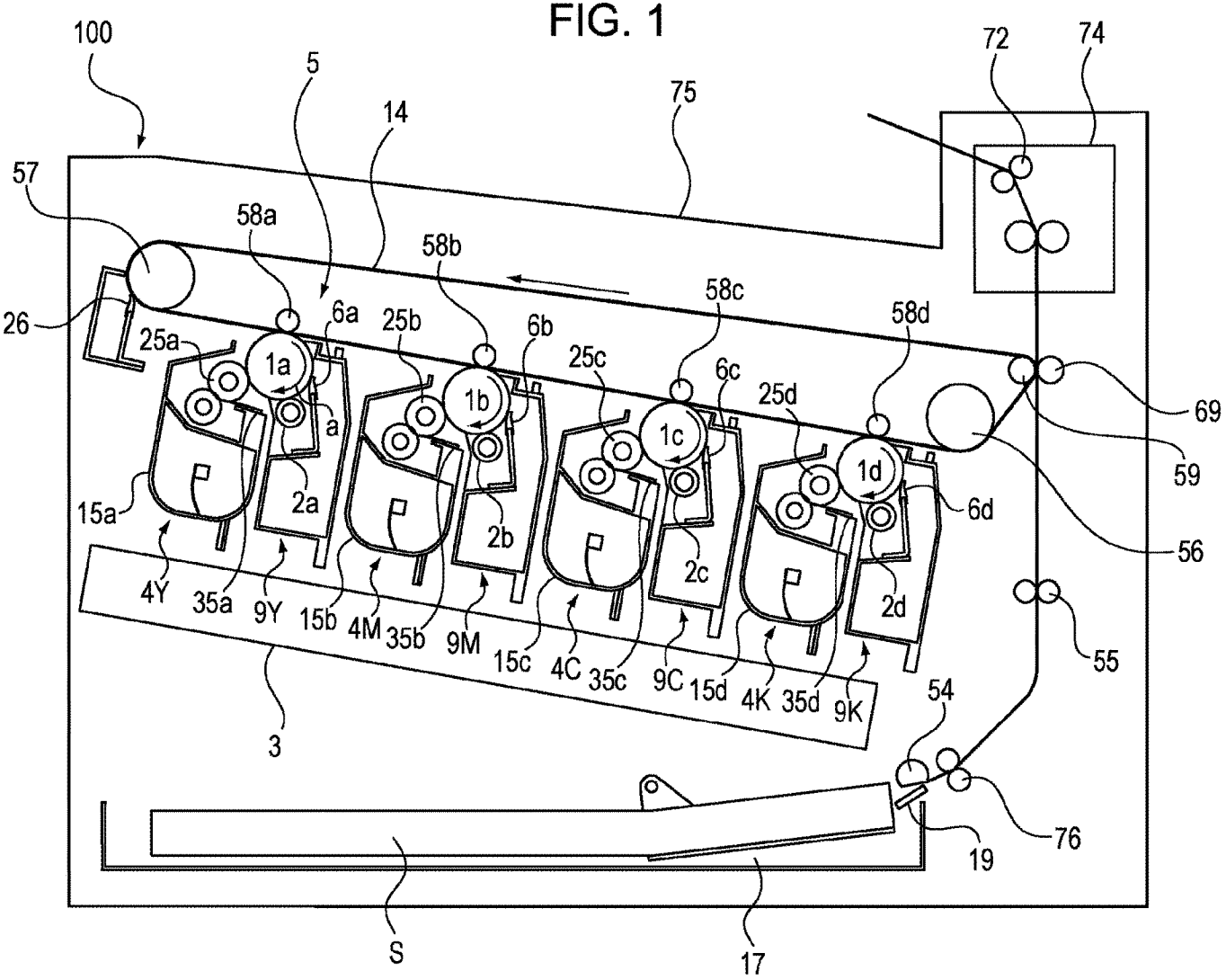
FIG. 1 is a cross-sectional view illustrating a configuration of an image forming apparatus according to an embodiment of the present disclosure.
Figure 2:
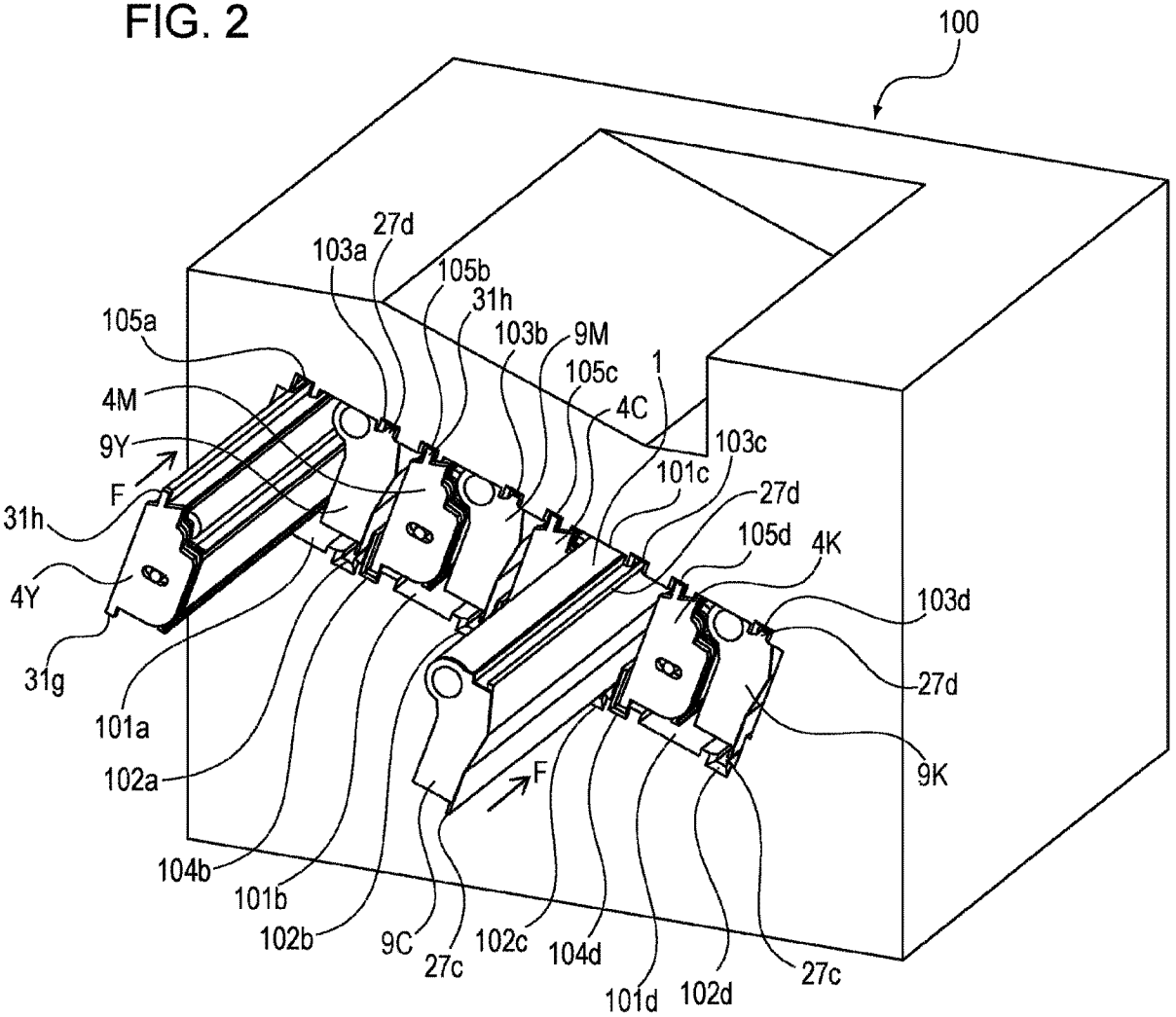
FIG. 2 is a perspective view illustrating how a drum cartridge and a developing cartridge are independently detachably mounted to a main body of the image forming apparatus.

A configuration of an image forming apparatus 100 in which a process cartridge according to an embodiment of the present disclosure is detachably mounted will be described with reference to FIGS. 1 and 2. FIG. 1 is a cross-sectional view illustrating a configuration of the image forming apparatus 100. FIG. 2 is a perspective view illustrating how a drum cartridge and a developing cartridge that form a process cartridge are independently detachably mounted to a main body of the image forming apparatus 100.

As illustrated in FIG. 2, the main body of the image forming apparatus 100 has openings 101*a*, 101*b*, 101*c*, and 101*d*. For convenience in explanation, the term "opening 101" may be used to refer to any of the openings 101*a*, 101*b*, 101*c*, and 101*d*. These openings 101 are arranged along a surface inclined at a predetermined angle with respect to the horizontal surface of the main body of the image forming apparatus 100.

Lower guides 102*a*, 102*b*, 102*c*, 102*d*, and 104*d*, each having a groove U-shaped in cross-section, are each provided in the corresponding opening 101. Additionally, upper guides 103*a*, 103*b*, 103*c*, 103*d*, 105*a*, 105*b*, 105*c*, and 105*d*, each having a groove U-shaped in cross-section, are each provided in the corresponding opening 101.

The term "lower guide 102" may be used to refer to any of the lower guides 102*a*, 102*b*, 102*c*, and 102*d*. Each lower guide 102 is positioned, with the open side of its groove U-shaped in cross-section facing substantially upward. The term "upper guide 103" may be used to refer to any of the upper guides 103*a*, 103*b*, 103*c*, and 103*d*. Each upper guide 103 is positioned, with the open side of its groove U-shaped in cross-section facing substantially downward.

The term "lower guide 104" may be used to refer to any of the lower guides and 104*b* and 104*d*. Each lower guide 104 is positioned, with the open side of its groove U-shaped in cross-section facing substantially upward.

For convenience in explanation, the term "drum cartridge 9" may be used to refer to any of drum cartridges 9Y, 9M, 9C, and 9K, each forming a process cartridge, and the term "developing cartridge 4" may be used to refer to any of developing cartridges 4Y, 4M, 4C, and 4K, each forming a process cartridge. The same applies to the other image formation processing units.

Note that the lower guides 104*a* and 104*c* are not shown in FIG. 2, as they are obstructed by the developing cartridge 4Y and the drum cartridge 9C in a pulled-out state. The term "upper guide 105" may be used to refer to any of the upper guides 105*a*, 105*b*, 105*c*, and 105*d*. Each upper guide 105 is positioned, with the open side of its groove U-shaped in cross-section facing substantially downward.

Figure 4:
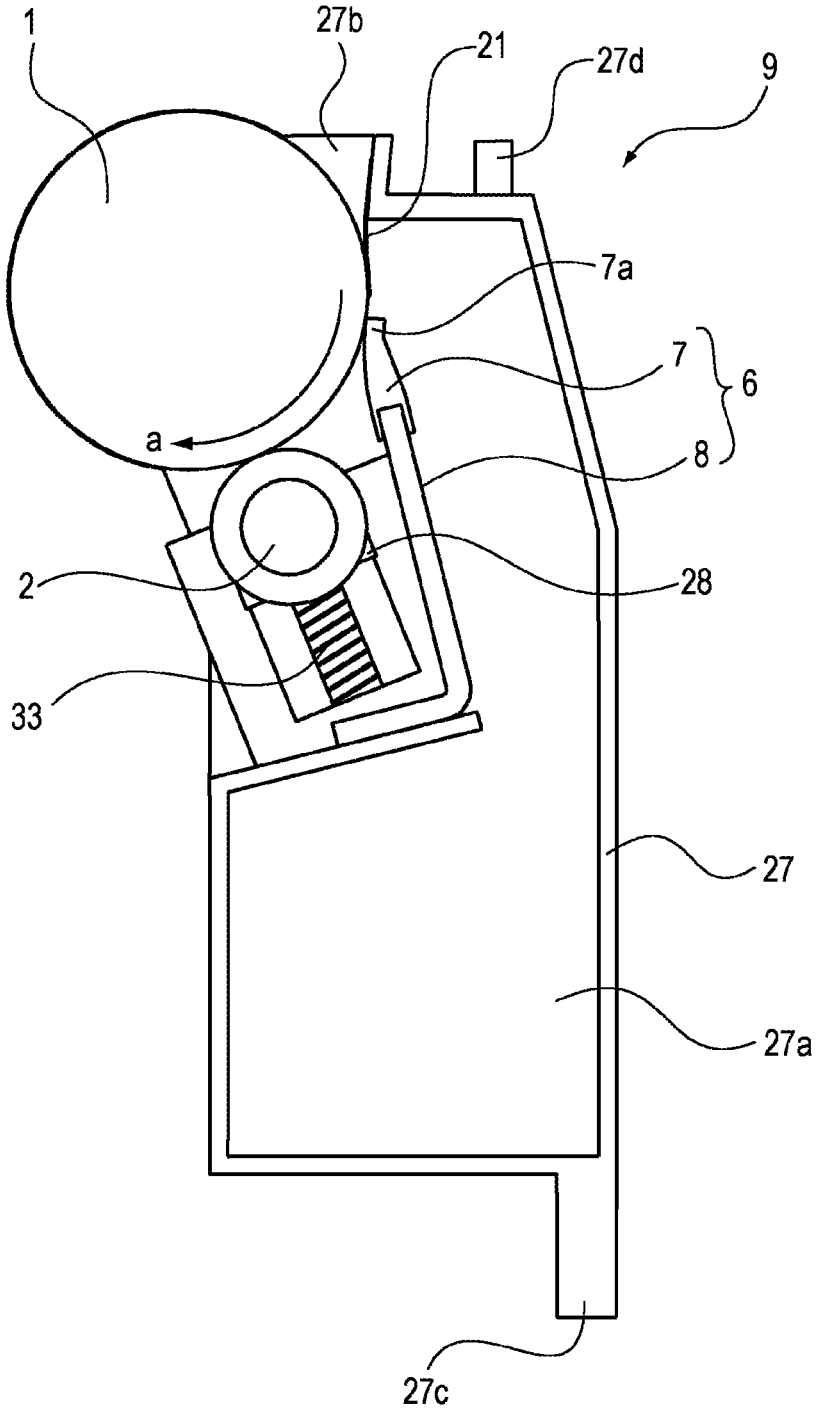
FIG. 4 is a cross-sectional view illustrating a configuration of the drum cartridge.

As illustrated in FIG. 4, a cleaning frame 27 of each drum cartridge 9 has protrusions 27*c* and 27*d* protruding downward and upward, respectively, from lower and upper ends of the cleaning frame 27. As illustrated in FIG. 2, the protrusion 27*c* of the drum cartridge 9 is slidably engaged in the groove of the lower guide 102 on the front side in the mounting direction, and the protrusion 27*d* of the drum cartridge 9 is slidably engaged in the groove of the upper guide 103 on the front side in the mounting direction. Then, the drum cartridge 9 is moved along the upper guide 103 and the lower guide 102 in the insertion direction indicated by arrow F in FIG. 2. The drum cartridge 9 can thus be inserted and mounted at a predetermined position in the main body of the image forming apparatus 100.

As illustrated in FIG. 2, a developing frame 31 (see FIG. 5) of each developing cartridge 4 has protrusions 31*g* and 31*h* protruding downward and upward, respectively, from lower and upper ends of the developing frame 31. As illustrated in FIG. 2, the protrusion 31*g* of the developing cartridge 4 is slidably engaged in the groove of the lower guide 104 on the front side in the mounting direction, and the protrusion 31*h* of the developing cartridge 4 is slidably engaged in the groove of the upper guide 105 on the front side in the mounting direction. Then, the developing cartridge 4 is moved along the upper guide 105 and the lower guide 104 in the insertion direction indicated by arrow F in FIG. 2. The developing cartridge 4 can thus be inserted and mounted at a predetermined position in the main body of the image forming apparatus 100.

The drum cartridges 9Y, 9M, 9C, and 9K and the developing cartridges 4Y, 4M, 4C, and 4K are thus independently detachably mounted to the main body of the image forming apparatus 100. Photosensitive drums 1*a* to 1*d* (see FIG. 1), each serving as an image bearing member, are rotatably supported by the respective cleaning frames 27 (frames) of the drum cartridges 9. Developing devices 15*a* to 15*d* (see FIG. 1; hereinafter they may be referred to as "developing devices 15"), each serving as a developing unit, are included in the respective developing cartridges 4.

In the image forming apparatus 100 illustrated in FIG. 2, the upstream side in the mounting direction of the drum cartridge 9 and the developing cartridge 4 (i.e., front side in FIG. 2) will be referred to as a front side of the image forming apparatus 100, and the downstream side in the mounting direction of the drum cartridge 9 and the developing cartridge 4 (i.e., back side in FIG. 2) will be referred to as a back side of the image forming apparatus 100.

As illustrated in FIGS. 1 and 2, the four drum cartridges 9 and the four developing cartridges 4 are arranged side by side along the surface inclined at a predetermined angle with respect to the horizontal surface of the main body of the image forming apparatus 100. The drum cartridges 9 and the developing cartridges 4 are each horizontal in the longitudinal direction.

Figure 5:
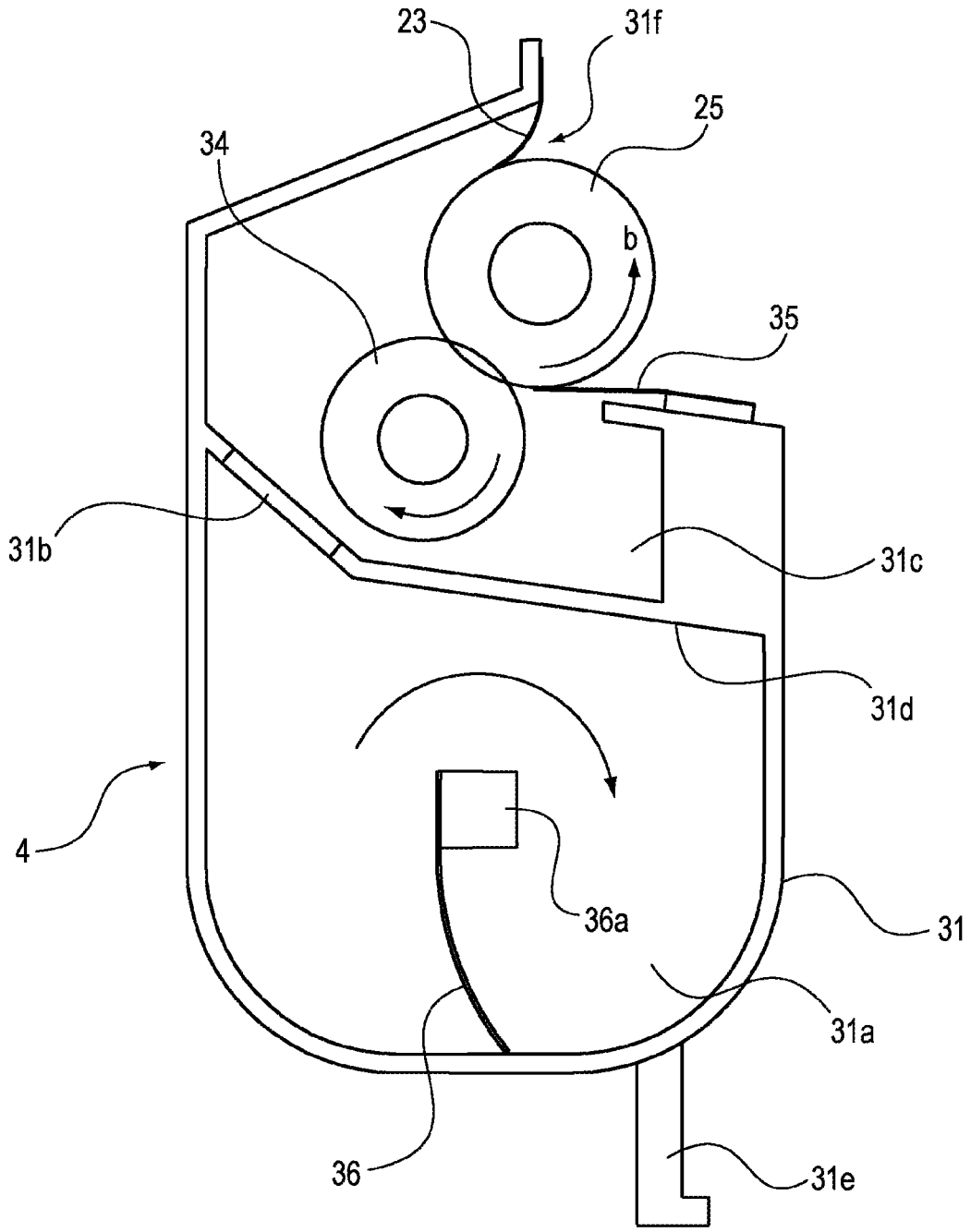
FIG. 5 is a cross-sectional view illustrating a configuration of the developing cartridge.

As illustrated in FIG. 4, each drum cartridge 9 forming a process cartridge includes a photosensitive drum 1 serving as an image bearing member and formed by an electrophotographic photosensitive member. The drum cartridge 9 further includes a charging roller 2 (charging roller 2*a*, 2*b*, 2*c*, or 2*d* in FIG. 1) serving as a charging unit and disposed adjacent to the photosensitive drum 1. The drum cartridge 9 further includes a cleaning member 6 (cleaning member 6*a*, 6*b*, 6*c*, or 6*d* in FIG. 1) serving as a cleaning unit. Image formation processing units, such as the photosensitive drum 1, the charging roller 2, and the cleaning member 6, are integrally provided in the drum cartridge 9. As illustrated in FIG. 5, image formation processing units, such as a developing roller 25 (developing roller 25*a*, 25*b*, 25*c*, or 25*d* in FIG. 1) serving as a developer bearing member and a developing blade 35 (developing blade 35*a*, 35*b*, 35*c*, or 35*d* in FIG. 1), are integrally disposed in each developing cartridge 4.

The charging roller 2 uniformly charges the surface of the photosensitive drum 1 rotating in the clockwise direction in FIG. 1. A scanner unit 3 serving as an image exposure unit is disposed below the drum cartridges 9 and the developing cartridges 4 illustrated in FIG. 1. The scanner unit 3 selectively exposes the surface of each photosensitive drum 1 to light to form an electrostatic latent image on the surface of the photosensitive drum 1. The developing roller 25 supplies a developer (toner) to the electrostatic latent image on the surface of the photosensitive drum 1 to develop and visualize the electrostatic latent image into a toner image.

A feeding cassette 17 holding recording materials S therein is detachably mounted in the lower part of the image forming apparatus 100 illustrated in FIG. 1. The recording materials S in the feeding cassette 17 are separately fed one by one by the cooperation of a feeding roller 54 and a separation pad 19. The recording material S fed by the feeding roller 54 is conveyed by conveying rollers 76 and brought into contact, at the leading edge thereof, with the nip between registration rollers 55 temporarily stopped. A skew of the recording material S is corrected by stiffness of the recording material S.

An intermediate transfer unit 5 where the toner image on the surface of each photosensitive drum 1 is primary-transferred is disposed above the drum cartridges 9 and the developing cartridges 4. The intermediate transfer unit 5 includes an intermediate transfer belt 14 which is stretched in such a way that it can be moved by a driving roller 56, a driven roller 57, and an inner secondary-transfer roller 59 in the counterclockwise direction in FIG. 1.

The inner periphery of the intermediate transfer belt 14 is provided with primary transfer rollers 58*a*, 58*b*, 58*c*, and 58*d* (which may hereinafter be referred to as "primary transfer rollers 58"), each serving as a primary transfer unit. The primary transfer rollers 58 are arranged to face the respective surfaces of the photosensitive drums 1 for different colors, with the intermediate transfer belt 14 interposed therebetween. An outer secondary-transfer roller 69 serving as a secondary transfer unit is disposed opposite the inner secondary-transfer roller 59, with the intermediate transfer belt 14 interposed therebetween.

The intermediate transfer belt 14 is moved in the counterclockwise direction in FIG. 1 while the outer periphery thereof is in contact with the surface of each photosensitive drum 1. By applying a primary transfer voltage to each of the primary transfer rollers 58, the toner images formed on the respective surfaces of the photosensitive drums 1 are sequentially primary-transferred to and superimposed on the outer periphery of the intermediate transfer belt 14.

The recording material S is conveyed at predetermined timing by the registration rollers 55 to a secondary transfer nip between the outer periphery of the intermediate transfer belt 14 and the outer secondary-transfer roller 69. Then, a predetermined secondary transfer voltage is applied to the inner secondary-transfer roller 59 disposed on the inner periphery of the intermediate transfer belt 14. Additionally, a predetermined secondary transfer voltage is applied to the outer secondary-transfer roller 69 disposed on the outer periphery of the intermediate transfer belt 14. The toner image on the outer periphery of the intermediate transfer belt 14 is thus secondary-transferred onto the recording material S.

The recording material S onto which the toner image has been secondary-transferred at the secondary transfer nip between the outer periphery of the intermediate transfer belt 14 and the outer secondary-transfer roller 69 is conveyed to a fixing device 74 serving as a fixing unit. The fixing device 74 is disposed in the upper part of the image forming apparatus 100 illustrated in FIG. 1. After the toner image is thermally fixed on the recording material S by the fixing device 74, the recording material S is discharged by discharge rollers 72 to an output unit 75.

(Image Forming Operation)

An image forming operation performed by the image forming apparatus 100 illustrated in FIG. 1 will now be described. First, each photosensitive drum 1 is rotated in the clockwise direction in FIG. 1, and the surface of the photosensitive drum 1 is uniformly charged by the corresponding charging roller 2. Then, the uniformly charged surface of the photosensitive drum 1 is selectively exposed to laser light which is emitted from the scanner unit 3 in accordance with image information. Electrostatic latent images are thus formed on the respective surfaces of the photosensitive drums 1. The developing roller 25 in the developing device 15 for each color supplies a developer (toner) to the electrostatic latent image on the surface of the corresponding photosensitive drum 1 to develop the electrostatic latent image into a toner image. Toner images of different colors are thus formed on the respective surfaces of the photosensitive drums 1.

In synchronization with formation of the toner images of different colors on the respective surfaces of the photosensitive drums 1, the recording material S is conveyed by the registration rollers 55 to the secondary transfer nip at which the inner secondary-transfer roller 59 and the outer secondary-transfer roller 69 are in contact with each other, with the intermediate transfer belt 14 interposed therebetween. Then, by applying a secondary-transfer bias voltage to the outer secondary-transfer roller 69, the toner images on the outer periphery of the intermediate transfer belt 14 are secondary-transferred onto the recording material S.

The recording material S having the resulting toner image thereon is subjected to heat and pressure while being sandwiched and conveyed between a fixing roller and a pressure roller in the fixing device 74. The toner image on the recording material S is thus thermally fused and fixed on the recording material S. Then, the recording material S is conveyed while being sandwiched between the discharge rollers 72 and discharged to the output unit 75.

After the toner image formed on the surface of each photosensitive drum 1 is primary-transferred onto the intermediate transfer belt 14, residual toner remaining on the surface of the photosensitive drum 1 is scraped off and removed by the cleaning member 6. After the toner images primary-transferred onto the outer periphery of the intermediate transfer belt 14 are secondary-transferred onto the recording material S, residual toner remaining on the outer periphery of the intermediate transfer belt 14 is scraped off and removed by a cleaning member 26 serving as a cleaning unit.

(Drum Cartridge)

Figure 3:
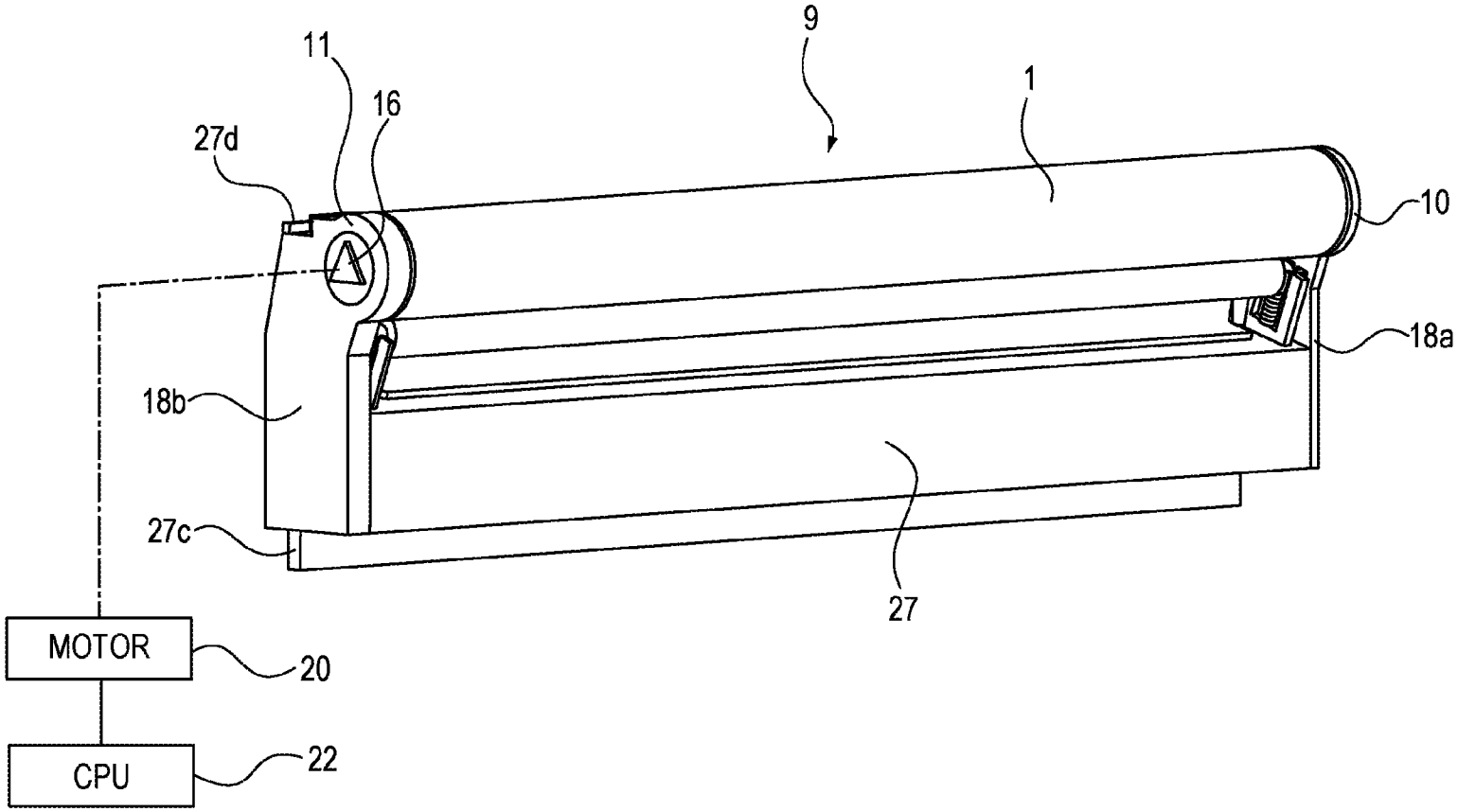
FIG. 3 is a perspective view illustrating a configuration of the drum cartridge.

A configuration of the drum cartridge 9, which forms a process cartridge, according to an embodiment of the present disclosure will now be described with reference to FIGS. 3 and 4. FIG. 3 is a perspective view illustrating a configuration of the drum cartridge 9, and FIG. 4 is a cross-sectional view illustrating the configuration of the drum cartridge 9. Note that the drum cartridges 9Y, 9M, 9C, and 9K illustrated in FIGS. 1 and 2 have the same configuration.

In the present embodiment, in the insertion direction of the drum cartridge 9 and the developing cartridge 4 indicated by arrow F in FIG. 2, the upstream side in the insertion direction (i.e., front side in FIG. 2) will be referred to as a front side of the image forming apparatus 100, and the downstream side in the insertion direction (i.e., back side in FIG. 2) will be referred to as a back side of the image forming apparatus 100.

As illustrated in FIG. 3, in the cleaning frame 27 of the drum cartridge 9, the photosensitive drum 1 is rotatably supported by bearings 10 and 11 in respective flanges 18*a* and 18*b*. The photosensitive drum 1 is provided with a drum coupling 16 on the side of the bearing 11, which is at one end in the longitudinal direction (axis direction) of the photosensitive drum 1. A rotational driving force from a motor 20 (see FIG. 3), serving as a driving source, is transmitted to the drum coupling 16.

As illustrated in FIG. 4, the charging roller 2 and the cleaning member 6 are disposed around the photosensitive drum 1. The cleaning member 6 is composed of an elastic member 7 formed by a rubber blade and a supporting member 8. The elastic member 7 extends from the supporting member 8 in a direction including a direction component opposite the rotation direction of the photosensitive drum 1 indicated by arrow a in FIG. 4. An end portion 7*a* of the elastic member 7 is brought into contact with the surface of the photosensitive drum 1.

Thus, residual toner remaining on the surface of the photosensitive drum 1 after primary transfer is scraped off and removed by the end portion 7*a* of the elastic member 7. The residual toner removed from the surface of the photosensitive drum 1 by the cleaning member 6 drops into a removed toner chamber 27*a* formed by the cleaning frame 27.

The cleaning frame 27 has an opening 27*b* that exposes part of the surface of the photosensitive drum 1 to the outside. To prevent the removed toner in the removed toner chamber 27*a* from leaking out through the opening 27*b*, one edge of a scooping sheet 21, which is supported at the other edge thereof by the cleaning frame 27, comes into contact with the surface of the photosensitive drum 1.

The rotational driving force of the motor 20 (see FIG. 3), serving as a driving source, is transmitted through the drum coupling 16 to the photosensitive drum 1 rotatably disposed in the drum cartridge 9 illustrated in FIG. 3. A central processing unit (CPU) 22, serving as a control unit, controls the motor 20 in accordance with the image forming operation to rotationally drive the photosensitive drum 1. The charging roller 2 is rotatably attached to the drum cartridge 9, with a bearing 28 (see FIG. 4) interposed therebetween. The charging roller 2 is pressed by a pressure member 33 against the surface of the photosensitive drum 1, and is rotated by the rotation of the photosensitive drum 1.

(Developing Cartridge)

A configuration of the developing cartridge 4 will now be described with reference to FIG. 5. FIG. 5 is a cross-sectional view illustrating a configuration of the developing cartridge 4. Toner serving as a developer is contained in a toner containing chamber 31*a* formed by the developing frame 31 of the developing cartridge 4 illustrated in FIG. 5.

A yellow toner, a magenta toner, a cyan toner, and a black toner are contained in the developing cartridge 4Y, the developing cartridge 4M, the developing cartridge 4C, and the developing cartridge 4K, respectively, illustrated in FIGS. 1 and 2. The developing cartridges 4 have the same configuration except that they contain toners of different colors.

In a developing chamber 31*c* formed by the developing frame 31 of the developing cartridge 4, the developing roller 25 that rotates in the direction of arrow b in FIG. 5 while being in contact with the surface of the photosensitive drum 1 is rotatably supported. Also in the developing chamber 31*c*, a supply roller 34 that rotates while being in contact with the surface of the developing roller 25 is rotatably supported. Additionally, the developing blade 35 that regulates the thickness of the toner layer on the surface of the developing roller 25 is supported by the developing frame 31.

The toner containing chamber 31*a* and the developing chamber 31*c* are separated by a partition wall 31*d*, which has an opening 31*b* passing therethrough. The toner containing chamber 31*a* and the developing chamber 31*c* communicate with each other through the opening 31*b*. In the toner containing chamber 31*a*, a conveying member 36 that stirs and conveys the toner contained in the toner containing chamber 31*a* is rotatably supported.

The toner contained in the toner containing chamber 31*a* is stirred by the conveying member 36 rotating about a rotation shaft 36*a* in the clockwise direction in FIG. 5, and is conveyed through the opening 31*b* into the developing chamber 31*c*. Then, the toner is supplied by the supply roller 34 rotating in the clockwise direction in FIG. 5 onto the surface of the developing roller 25. The thickness of the toner layer on the surface of the developing roller 25 is regulated by the developing blade 35.

The developing chamber 31*c* has an opening 31*f* that exposes part of the surface of the developing roller 25 to the outside. To prevent the toner in the developing chamber 31*c* from leaking out through the opening 31*f*, one edge of a seal member 23, which is supported at the other edge thereof by the developing frame 31, comes into contact with the surface of the developing roller 25. In the rotation direction of the developing roller 25 indicated by arrow b in FIG. 5, the seal member 23 is disposed downstream of a developing position where the developing roller 25 and the photosensitive drum 1 face each other, whereas the developing blade 35 is disposed upstream of the developing position.

The developing frame 31 has a biased portion 31*e* biased by a biasing member (not shown) in the main body of the image forming apparatus 100. Additionally, the developing frame 31 has a back developing bearing (not shown) and a front developing bearing (not shown) on both sides of each of the developing roller 25 and the supply roller 34 in the longitudinal direction (axis direction). With the back developing bearing and the front developing bearing described above, the developing roller 25 and the supply roller 34 are each rotatably supported by the developing frame 31.

(Mounting of Drum Cartridge and Developing Cartridge)

A configuration for inserting and mounting the drum cartridge 9 and the developing cartridge 4 to the main body of the image forming apparatus 100 will now be described with reference to FIG. 2. As illustrated in FIG. 2, the drum cartridge 9 and the developing cartridge 4 are each inserted into the corresponding opening 101 in the main body of the image forming apparatus 100. Specifically, the drum cartridge 9 and the developing cartridge 4 are inserted from the front side of the image forming apparatus 100 (i.e., front side in FIG. 2) toward the back side of the image forming apparatus 100 (i.e., back side in FIG. 2) in the direction parallel to the longitudinal direction (axis direction) of the photosensitive drum 1 indicated by arrow F in FIG. 2.

In the present embodiment, the upstream side in the insertion direction of the drum cartridge 9 and the developing cartridge 4 indicated by arrow F in FIG. 2 will be referred to as a front side of the image forming apparatus 100 (i.e., front side in FIG. 2), and the downstream side in the insertion direction will be referred to as a back side of the image forming apparatus 100 (i.e., back side in FIG. 2).

As illustrated in FIG. 2, the upper guide 103 U-shaped in cross-section and serving as a first guide corresponding to each drum cartridge 9 is disposed on the upper right side in the corresponding opening 101 in the main body of the image forming apparatus 100, and the lower guide 102 U-shaped in cross-section and serving as a second guide corresponding to the drum cartridge 9 is disposed on the lower right side in the opening 101. The upper guide 103 and the lower guide 102 are each formed by a rail member U-shaped in cross-section and extending along the insertion direction of the drum cartridge 9 indicated by arrow F in FIG. 2.

Similarly, the upper guide 105 U-shaped in cross-section and serving as a third guide corresponding to each developing cartridge 4 is disposed on the upper left side in the corresponding opening 101 in the main body of the image forming apparatus 100, and the lower guide 104 U-shaped in cross-section and serving as a fourth guide corresponding to the developing cartridge 4 is disposed on the lower left side in the opening 101. The upper guide 105 and the lower guide 104 are each formed by a rail member U-shaped in cross-section and extending along the insertion direction of the developing cartridge 4 indicated by arrow F in FIG. 2.

(Aspect of the Present Disclosure)

Figure 6B:
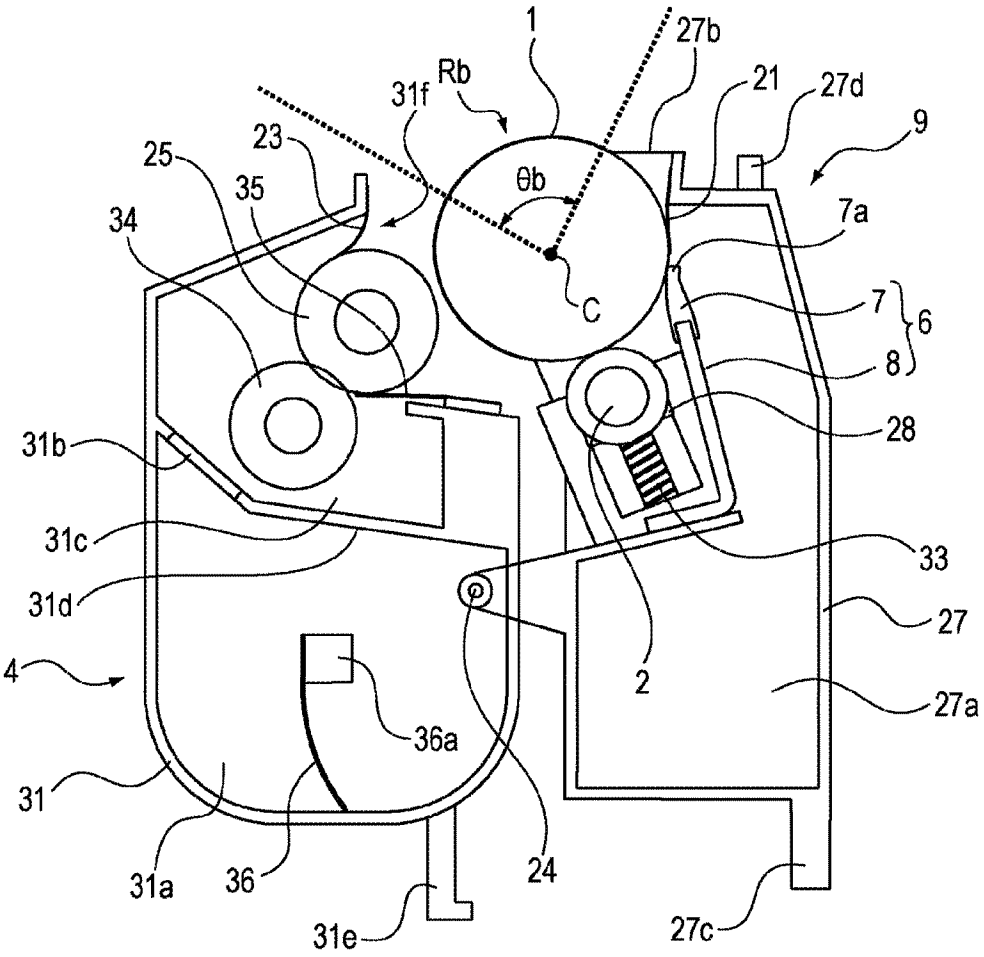
FIG. 6B is a cross-sectional view illustrating an exposed region of the surface of the photosensitive drum when the drum cartridge and the developing cartridge are coupled to form an integral unit in such a way that they can turn about a turning shaft.
Figure 6A:
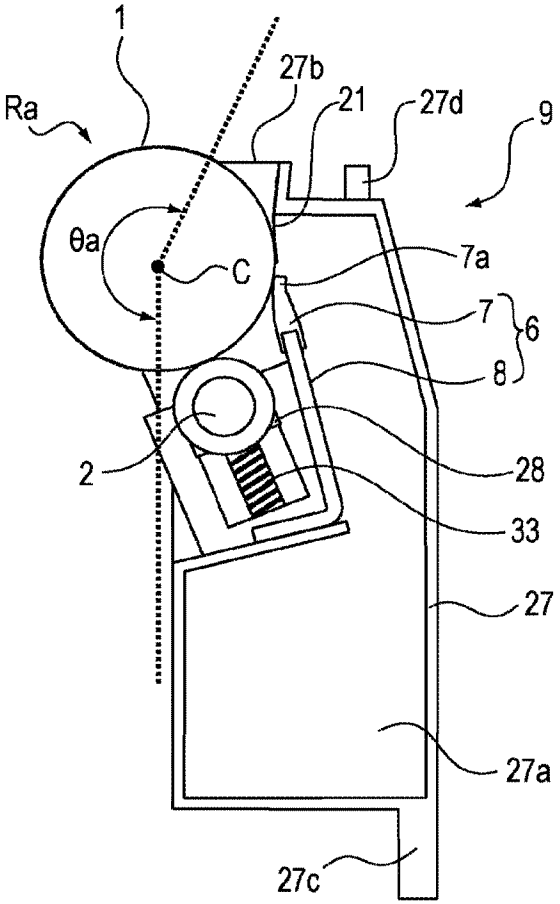
FIG. 6A is a cross-sectional view illustrating an exposed region of the surface of a photosensitive drum when the drum cartridge and the developing cartridge are configured as separate components.

A configuration for warning the user not to touch the surface of the photosensitive drum 1, which is an aspect of the present disclosure, will now be described with reference to FIGS. 6A and 6B, FIG. 7, and FIG. 8. FIG. 6A is a cross-sectional view illustrating an exposed region of the surface of the photosensitive drum 1 when the drum cartridge 9 and the developing cartridge 4 are configured as separate components. FIG. 6B is a cross-sectional view illustrating an exposed region of the surface of the photosensitive drum 1 when the drum cartridge 9 and the developing cartridge 4 are coupled to form an integral unit in such a way that they can turn about a turning shaft 24. FIGS. 6A and 6B are cross-sectional views of the drum cartridge 9 and the developing cartridge 4 as viewed in the direction of the rotation axis of the photosensitive drum 1.

Figure 7:
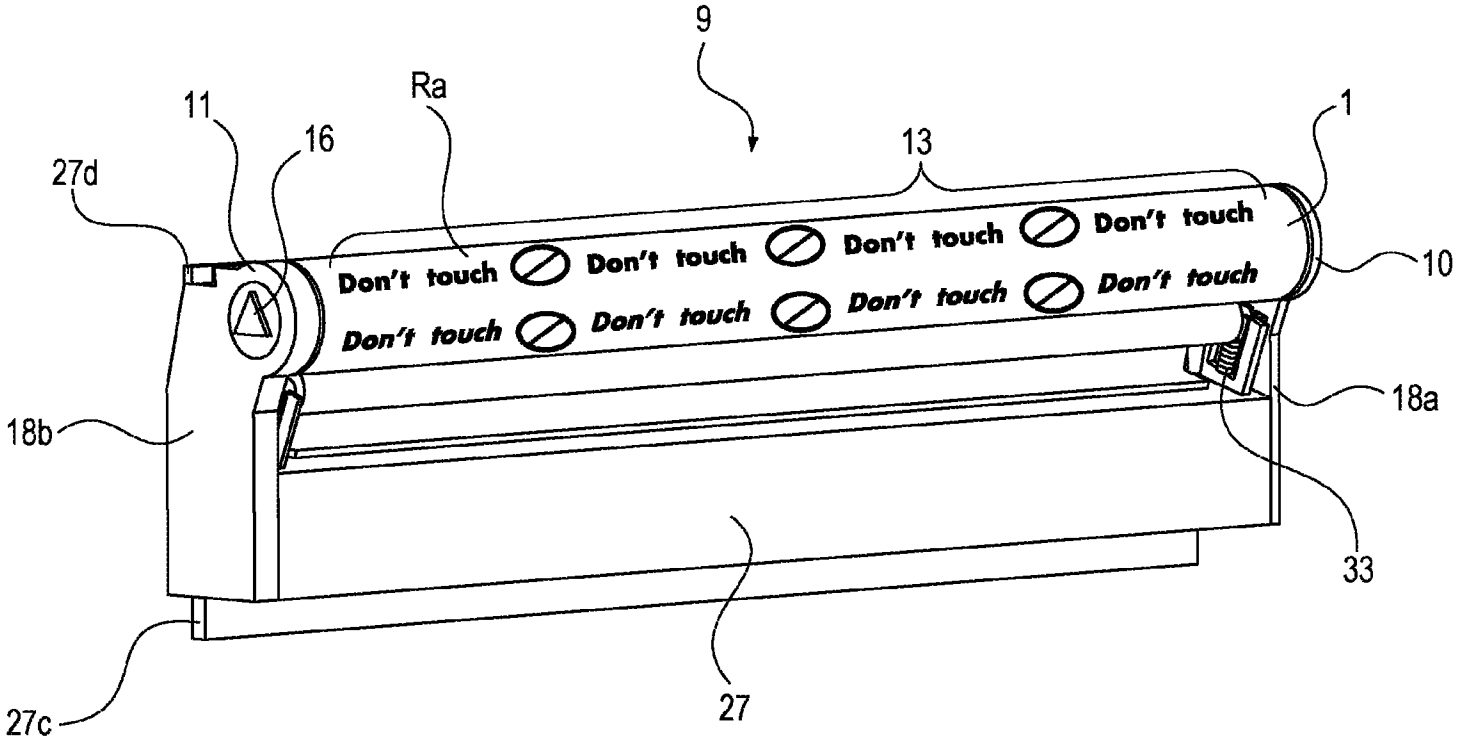
FIG. 7 is a perspective view illustrating how handling caution information warning the user not to touch the surface of the photosensitive drum appears on the surface of the photosensitive drum.
Figure 8:
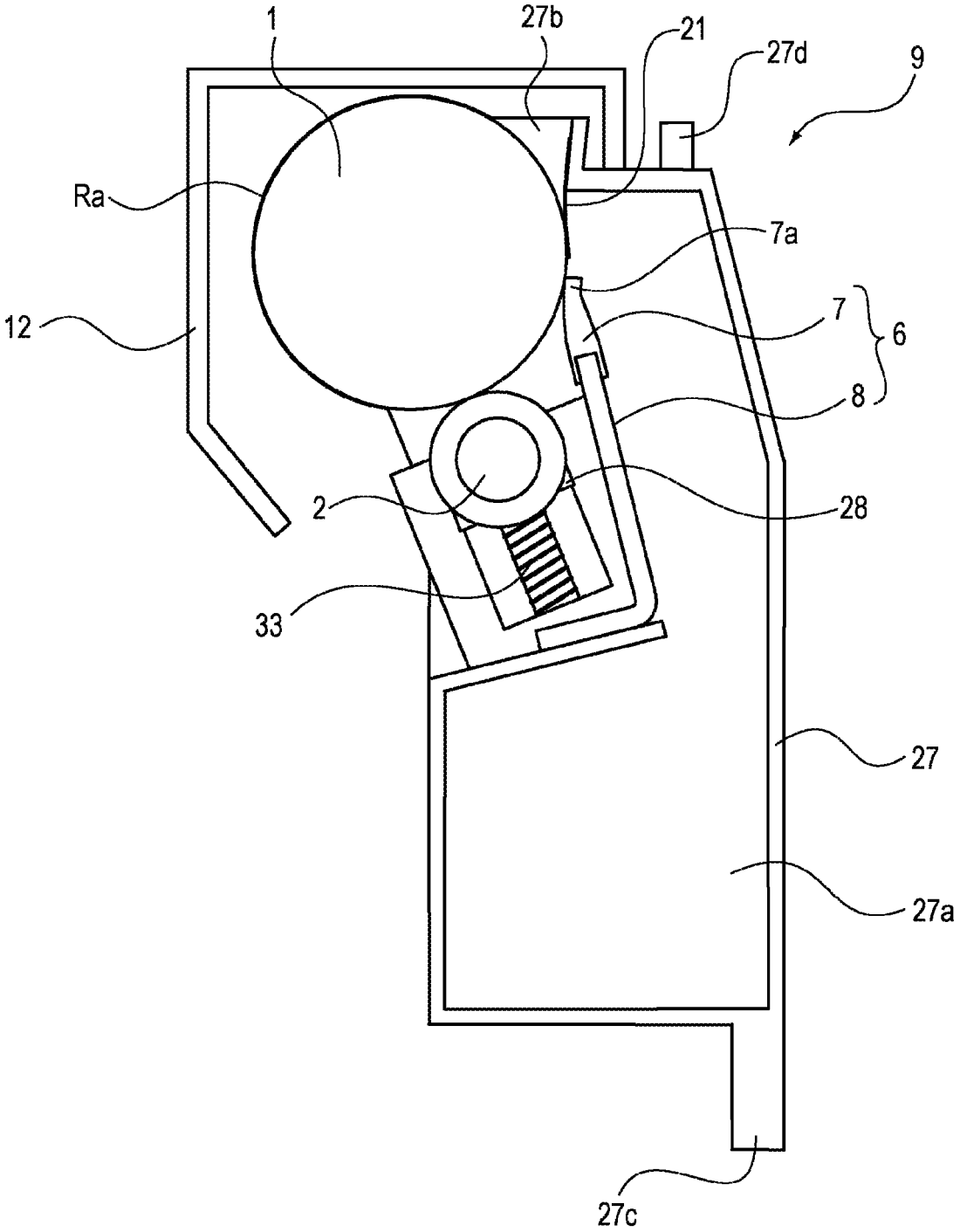
FIG. 8 is a cross-sectional view illustrating a configuration of a drum cover detachably factory-mounted on a cleaning frame of the drum cartridge.

FIG. 7 is a perspective view illustrating how handling caution information 13, which is contact prohibiting information warning the user not to touch the surface of the photosensitive drum 1, appears on the surface of the photosensitive drum 1. FIG. 8 is a cross-sectional view illustrating a configuration of a drum cover 12 detachably factory-mounted on the cleaning frame 27 of the drum cartridge 9.

As illustrated in FIG. 6A, the surface of the photosensitive drum 1 is significantly exposed from the opening 27*b* in the drum cartridge 9 when the drum cartridge 9 and the developing cartridge 4 are configured as separate components. Therefore, when, as in FIG. 2, the user holds the drum cartridge 9 and attaches or detaches it to or from the main body of the image forming apparatus 100, the user may touch the surface of the photosensitive drum 1 significantly exposed from the opening 27*b*.

As illustrated in FIGS. 6A and 6B, the photosensitive drum 1 is a cylindrical member. Regions Ra and Rb of the surface of the photosensitive drum 1 are exposed from the openings 27*b* and 31*f*, respectively, to the outside and can be touched by the user. The size of each of the regions Ra and Rb is expressed by a central angle of a circular sector centered at a rotation center C of the photosensitive drum 1.

That is, the region of the central angle θ is a region having an arc corresponding to the central angle, as viewed in the direction of the rotation axis of the photosensitive drum 1. The central angle of the circular sector corresponding to the region Ra when the drum cartridge 9 and the developing-cartridge 4 are configured as separate components (see FIG. 6A) is denoted by θa. The central angle of the circular sector corresponding to the region Rb when the drum cartridge 9 and the developing cartridge 4 are configured as an integral unit (see FIG. 6B) is denoted by θb. The central angles θa and θb satisfy the relation θa>θb.

When, as in FIG. 2, the user holds the drum cartridge 9 and attaches or detaches it to or from the main body of the image forming apparatus 100, if the user touches the surface of the photosensitive drum 1 exposed from the opening 27*b*, the adhesion of finger oil or the like to the surface of the photosensitive drum 1 may affect image quality. In particular, if the central angle θa corresponding to the region Ra of the surface of the photosensitive drum 1 that can be touched by the user is 180° or more (i.e., if the area of the region Ra is greater than or equal to half the area of the entire outer periphery of the cylindrical photosensitive drum 1), the user is more likely to accidentally touch the surface of the photosensitive drum 1. As illustrated in FIG. 6A, the region Ra of the photosensitive drum 1 exposed from the opening 27*b* is a region having an arc corresponding to the central angle θa, as viewed in the direction of the rotation axis of the photosensitive drum 1, and the central angle θa is greater than 180°.

As illustrated in FIG. 8, to prevent the user from touching the surface of the photosensitive drum 1, the drum cover 12 serving as a protective member that covers the surface of the photosensitive drum 1 is detachably mounted on the cleaning frame 27 of the drum cartridge 9 in a factory default state. The drum cover 12 illustrated in FIG. 8 has the function of protecting the surface of the photosensitive drum 1 from light, dust, and user's touch.

The drum cover 12 attached to the cleaning frame 27 covers at least part of the region Ra of the photosensitive drum 1 exposed from the opening 27*b*. At least part of the region Ra of the photosensitive drum 1 exposed from the opening 27*b* is a region exposed from the opening 27*b* when the drum cover 12 (protective member) is off the cleaning frame 27 (frame). Therefore, after shipment of the drum cartridge 9 from the factory, the surface of the photosensitive drum 1 can be protected until the user removes the drum cover 12 from the cleaning frame 27 of the drum cartridge 9.

After removing the drum cover 12 from the cleaning frame 27 of the drum cartridge 9, the user holds the drum cartridge 9 and inserts and mounts it through the opening 101 in the main body of the image forming apparatus 100 as in FIG. 2. When the user holds the drum cartridge 9 and inserts and mounts it through the opening 101 in the main body of the image forming apparatus 100, the surface of the photosensitive drum 1 exposed to the outside from the opening 27*b* in the drum cartridge 9 is not protected by the drum cover 12, as illustrated in FIG. 6A. This means that the user may touch the surface of the photosensitive drum 1.

The user holds the drum cartridge 9 and inserts and mounts it through the opening 101 in the main body of the image forming apparatus 100. It is necessary in this case to prevent the user from touching the surface of the photosensitive drum 1. In the present embodiment, as illustrated in FIG. 7, the drum cartridge 9 (process cartridge) in the factory default state is as described below. That is, the handling caution information 13, such as "Don't touch" is formed (printed) as a toner image (developer image) in at least part of the region Ra of the surface of the photosensitive drum 1 (image bearing member) exposed from the opening 27*b*. The handling caution information 13 of the present embodiment is contact prohibiting information that warns the user not to touch the surface of the photosensitive drum 1.

After the user removes the drum cover 12 from the cleaning frame 27 of the drum cartridge 9, the user can see the handling caution information 13 on the surface of the photosensitive drum 1. It is thus possible to warn the user not to touch the surface of the photosensitive drum 1, and to reduce the risk of the user touching the surface of the photosensitive drum 1.

The toner used to form the handling caution information 13 on the surface of the photosensitive drum 1 may be of any color that is easily noticeable. In the present embodiment, the handling caution information 13 is formed as a toner image on the surface of the photosensitive drum 1. Alternatively, fine particles, such as resin microparticles (e.g., silicone resin microparticles), may be used to print the handling caution information 13 on the surface of the photosensitive drum 1 (image bearing member).

As the handling caution information 13, contact prohibiting information that warns the user not to touch the surface of the photosensitive drum 1 is printed on the surface of the photosensitive drum 1. For example, the message, such as "Don't touch" or "Prohibited from contact", is printed, which allows the user to recognize that it is undesirable to touch the surface of the photosensitive drum 1.

The handling caution information 13 is written in a language, such as English, which is understandable by the user, but the language to be printed is not limited to English. The handling caution information 13 may be written in multiple languages for different regions where the image forming apparatus 100 may be used. This makes it possible to warn users in a wide variety of regions. The handling caution information 13 may be printed in the form of text, symbol, or picture on the surface of the photosensitive drum 1 to warn the user.

A process of printing the handling caution information 13 will now be described. The handling caution information 13 is printed on the surface of the photosensitive drum 1 in the final stage of production of the drum cartridge 9. Specifically, the main body of the image forming apparatus 100 is positioned at the final point of the production line for the drum cartridge 9, and the handling caution information 13 is formed as a toner image on the surface of the photosensitive drum 1 in cooperation with the developing cartridge 4 illustrated in FIG. 5. Alternatively, the printing process may involve using a tool for printing and adhering the handling caution information 13 onto the surface of the photosensitive drum 1. With the tool positioned at the final point of the production line for the drum cartridge 9, the handling caution information 13 is printed on the surface of the photosensitive drum 1.

It is necessary to prevent the handling caution information 13 formed as a toner image on the surface of the photosensitive drum 1 from scattering during transport after shipment of the drum cartridge 9 from the factory. Therefore, the toner image of the handling caution information 13 is adsorbed on the surface of the photosensitive drum 1 in a sufficiently charged state.

When the drum cartridge 9 is shipped from the factory, the surface of the photosensitive drum 1 is protected, as illustrated in FIG. 8, by the drum cover 12 mounted on the cleaning frame 27. The toner image of the handling caution information 13 can thus be reliably prevented from scattering after the drum cartridge 9 is shipped from the factory.

To minimize dirt on the user's hand in the event of touching the toner image of the handling caution information 13 formed on the surface of the photosensitive drum 1, the toner image of the handling caution information 13 is printed with the lowest density which can help draw user's attention to the handling caution information 13.

After inserting each of the drum cartridge 9 and the developing cartridge 4 into the corresponding opening 101 in the main body of the image forming apparatus 100 (see FIGS. 1 and 2) and mounting them at predetermined positions, the user presses a print start button on an operation panel (not shown). In response to this, before starting a normal image forming operation, the CPU 22 serving as a control unit drives and controls the motor 20 to rotate the photosensitive drum 1 in the direction of arrow a in FIG. 1. Then, the cleaning member 6 scrapes off and removes, in advance, the handling caution information 13 printed on the surface of the photosensitive drum 1 with toner (developer) or fine particles, such as silicone resin microparticles (resin microparticles). The photosensitive drum 1 is then used to carry out the normal image forming operation.

In the present embodiment, the drum cartridge 9 is shipped from the factory, with a toner image of the handling caution information 13 printed on the surface of the photosensitive drum 1. This makes it possible to warn the user not to touch the surface of the photosensitive drum 1. It is thus possible to provide the drum cartridge 9 (process cartridge) that can reduce the risk of the user touching the surface of the photosensitive drum 1.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-079418 filed Apr. 12, 2016, which is hereby incorporated by reference herein in its entirety.

What is claimed is:

1. A cartridge mountable to a main body of an image forming apparatus, the main body including a unit having a developer member for supplying a developer to the cartridge, the cartridge comprising:

a frame; and a photosensitive member rotatably supported by the frame, the photosensitive member being to be contacted with the developer member, wherein the frame includes an opening through which a part of a surface of the photosensitive member is exposed outside, and wherein in a factory default state of the cartridge, a first surface region of the photosensitive member is exposed and handling caution information is printed on at least a part of the first surface region of the photosensitive member, the first surface region of the photosensitive member including a second surface region that is to be contacted with the developer member.

2. The cartridge according to claim 1, wherein the handling caution information is printed with the developer.

3. The cartridge according to claim 1, wherein the handling caution information is printed with resin microparticles.

4. The cartridge according to claim 1, wherein the handling caution information is contact prohibiting information warning a user not to touch the image bearing member.

5. The cartridge according to claim 1, wherein the handling caution information is printed in the form of at least one of text, symbol, and picture.

6. The cartridge according to claim 1, wherein the photosensitive member is a cylindrical member, wherein the first surface region of the photosensitive member is a region having an arc corresponding to a central angle θa as viewed in a direction of a rotation axis of the photosensitive member, and wherein the central angle θa is greater than or equal to 180°.

7. The cartridge according to claim 1, wherein in the factory default state of the cartridge, the handling caution information is printed on the second surface region of the photosensitive member.

8. A cartridge mountable to a main body of an image forming apparatus, the main body including a unit having a developer member for supplying a developer to the cartridge, the cartridge comprising:

a photosensitive member that is to be contacted with the developer member;

a frame including an opening through which a part of a surface of the photosensitive member is exposed outside, configured to support the photosensitive member rotatably, and a protective member removably attached to the frame, configured to cover the opening of the frame so as to protect the photosensitive member, wherein in a factory default state of the cartridge, when the protective member is removed from the frame, a first surface region of the photosensitive member is exposed outside through the opening of the frame, and handling caution information is printed on at least a part of the first surface region of the photosensitive member, the first surface region including a second surface region of the photosensitive member that is to be contacted with the developer member.

9. The cartridge according to claim 8, wherein the handling caution information is printed with a developer.

10. The cartridge according to claim 8, wherein the handling caution information is printed with resin microparticles.

11. The cartridge according to claim 8, wherein the handling caution information is contact prohibiting information warning a user not to touch the image bearing member.

12. The cartridge according to claim 8, wherein the handling caution information is printed in the form of at least one of text, symbol, and picture.

13. The cartridge according to claim 8, wherein the photosensitive member is a cylindrical member, wherein the first surface region of the photosensitive member is a region having an arc corresponding to a central angle θa as viewed in a direction of a rotation axis of the photosensitve member, and wherein the central angle θa is greater than or equal to 180°.

14. The cartridge according to claim 8, wherein in the factory default state of the cartridge, the handling caution information is printed on the second surface region of the photosensitive member.

* * * * *